United States Patent [19]

Moll

[11] Patent Number: 4,767,392

[45] **Date of Patent: * Aug. 30, 1988**

[54] UNIVERSAL ROLLER FOR GLUE APPLYING FOLDING MACHINES

[76] Inventor: Richard J. Moll, c/o Dick Moll & Sons, Warminster, Pa. 18974

[ * ] Notice: The portion of the term of this patent subsequent to Mar. 17, 2004 has been disclaimed.

[21] Appl. No.: 26,863

[22] Filed: Mar. 17, 1987

Related U.S. Application Data

[63] Continuation-in-part of Ser. No. 703,726, Feb. 21, 1985, Pat. No. 4,650,454.

[51] Int. Cl.[4] ..... B05C 1/00

[52] U.S. Cl. ..... 493/331; 493/420; 493/442; 156/204

[58] Field of Search ..... 493/331, 333, 419–421, 493/442, 443, 454, 468; 156/204; 29/119, 121.4, 124, 125, 129, 130; 118/411–413

[56] References Cited

U.S. PATENT DOCUMENTS

| | | | |
|---|---|---|---|
| 1,543,354 | 6/1925 | Zacher | 493/333 |
| 1,709,282 | 4/1929 | Rader | 493/419 |
| 2,001,399 | 5/1935 | Scharwath | 493/442 |
| 3,964,658 | 6/1976 | Edwards | 29/125 |
| 4,650,454 | 3/1987 | Moll | 493/442 |

*Primary Examiner*—Frederick R. Schmidt
*Assistant Examiner*—Robert L. Showalter
*Attorney, Agent, or Firm*—Z. T. Wobensmith, III

[57] ABSTRACT

A universal roller for glue applying folding machines is disclosed which engages paper sheets to be advanced for folding, and which sheets have had one or more lines of glue applied thereto, which roller includes a plurality of spaceable segmented roller elements, detachably secured to a metal shaft, which elements, have an outer surface for engagement with said paper sheets.

7 Claims, 2 Drawing Sheets

UNIVERSAL ROLLER FOR GLUE APPLYING FOLDING MACHINES

CROSS-REFERENCE TO RELATED APPLICATIONS

This application is a continuation-in-part application of my prior application Ser. No. 703,726, filed Feb. 21, 1985, entitled "Roller For Glue Applying Folding Machines", now U.S. Pat. No. 4,650,454.

BACKGROUND OF THE INVENTION

1. Field of the Invention

This invention relates to rollers for advancing paper sheets into paper folding machines, and more particularly to a universal roller for use with glue applying paper folding machines, which roller includes a plurality of detachable, spaceable segmented roller elements, carried on a metal shaft.

2. Description of the Prior Art

In certain paper folding machine operations, it is necessary and desirable to be able to apply lines of glue to the paper sheets prior to folding so that they may be folded and bound in the folding machine. Examples of products obtained by using papers with glue lines thereon would be double lottery tickets, wallets, and multiple page documents. It is important that none of the glue which is laid down on the paper sheets prior to folding, actually get on the surfaces of the rollers which transport the paper sheets, as the paper sheets would then stick to the roller and interfere with the machine's operation.

The common practice in the folding machine industry when it is desired to lay down glue lines on paper sheets, is to groove the roller or set of rollers which pick up the paper at the glue locations. With this approach, every time the location of the glue lines are changed it is necessary to remove and groove the roller or rollers or to install other rollers, all of which is awkward, expensive, and time consuming.

Various rollers have been used in folding machines for paper advancement, such as those disclosed in the U.S. patent to Shuster No. 3,796,423; and Moll No. 4,375,971, which while suitable for paper advancement, would not be useful for advancing paper sheets with glue lines without drastic modifications which could defeat their intended purpose, and/or result in the problems described above.

Moll in U.S. Pat. No. 4,650,454 describes a glue applying roller for folding machines which is satisfactory, but which includes a plurality of helical grooves separating a plurality of flat faces on the outer covering, and may not be desirable for all applications.

The universal roller of the invention provides a surface for paper engagement and a plurality of roller elements on a shaft, with easy placement and replacement of the roller elements, to accommodate different numbers and spacings of gluing lines.

SUMMARY OF THE INVENTION

In accordance with the invention, a universal roller for glue applying folding machines, is disclosed which includes a plurality of separable segmented roller elements for advancing paper sheets to a folding machine for folding, which elements are detachably secured to a metal shaft, capable of being in spaced or meeting relation, and to have outer surfaces for paper engagement.

The principal object of the invention is to provide a universal roller for glue applying paper folding machines which is capable of use with a plurality of different arrangements of glue applying folding machines as an idler or as a driven roller.

A further object of the invention is to provide a universal roller of the character aforesaid wherein the roller elements are easily placed and replaced on the roller shaft to accommodate varying placements of glue lines.

A further object of the invention is to provide a universal roller of the character aforesaid which can be provided with a combination of roller elements having the same or different outer surfaces.

A further object of the invention is to provide a universal roller of the character aforesaid which is durable and long lasting in service.

A further object of the invention is to provide a universal roller of the character aforesaid which can be easily manufactured.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 1:
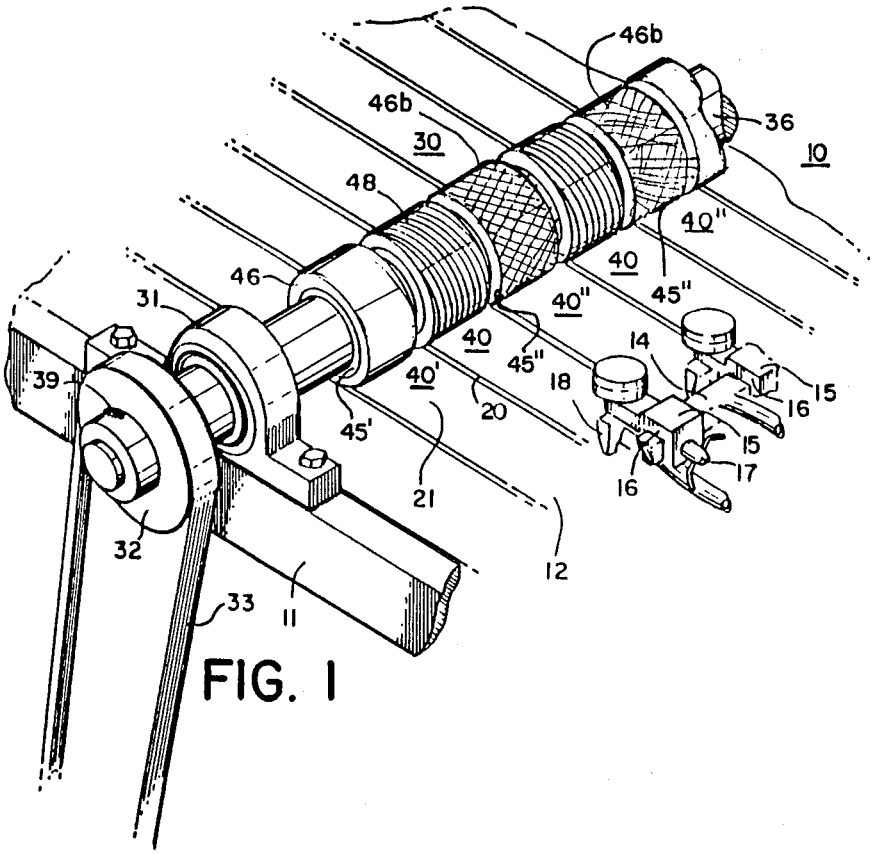
FIG. 1 is a fragmentary perspective view illustrating one embodiment of the roller of the invention in place in a typical paper folding machine.

Referring now more particularly to the drawings and FIGS. 1 to 6 thereof, a portion of a typical paper folding machine 10 is illustrated in FIG. 1 in fragmentary form. The machine 10 includes a side frame rail 11, a moving conveyor belt 12, and a transversely extending glue head mounting bar 14, which has a plurality of glue heads 15 mounted thereon. The glue heads 15 are capable of transverse movement along the bar 14, which can be fastened to the folding machine in well known manner.

The glue heads 15 are of conventional type, each head having a mounting block 16, which engages the bar 14, a thumbscrew 17 engaged with the block 16 and bar 14, for retaining the heads 15 at the desired locations, and a nozzle 18 for dispensing or laying down glue lines 20, on sheets of paper 21.

Figure 2:
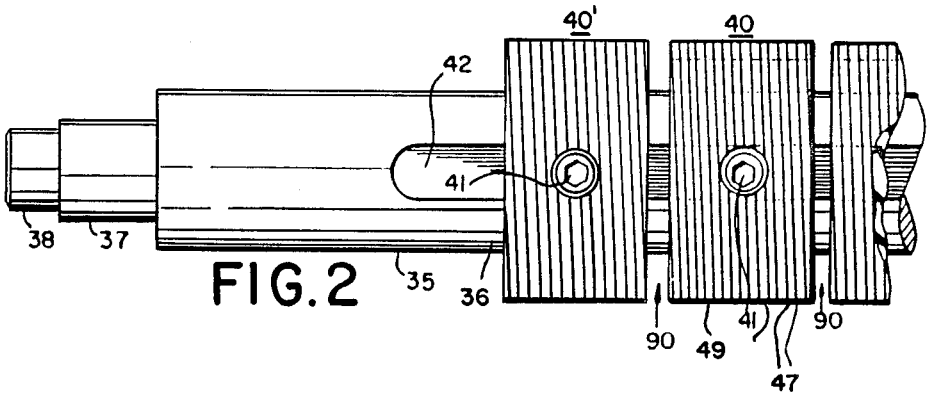
FIG. 2 is a fragmentary side elevational view of the roller of the invention.

In FIGS. 1 and 2 one embodiment of universal roller 30 is shown having a central shaft 35 which is carried in a bearing block 31, which is mounted to the side frame rail 11 and may be mounted at its opposite end in the same manner (not shown). The roller 30 has a pulley 32 mounted thereto, with a belt 33 engaged therewith, which belt extends to a driving motor (not shown). The shaft 35 as illustrated, is preferably of metal, with a center section 36 and reduced diameter journal 37 for rotation in the bearing block 31, and which has a further reduced diameter portion 38 to which the pulley 32 is secured by set screw 39 in well known manner. The universal roller 30 has a plurality of roller elements 40, 40', and 40'' mounted to the shaft 35 by set screws 41 which engage a flat 42, on the center section 36 of shaft 35 to prevent rotation and sidewise movement of the elements 40, 40', and 40''.

The roller elements 40 each include a collar 45, which fits over the center section 36 of shaft 35, preferably formed of aluminum but which can be formed of other materials as desired. The collar 45 each has a layer or covering 46 thereon preferably of urethane which is capable of being vulcanized and machinable. The urethane, after vulcanization, may have a durometer reading in the range from 60 to 70, and is preferably 65. The covering 46 is of a thickness of approximately one-eighth of an inch and after vulcanization has helical grooves 47 cut therein so that ribs 48 formed thereby have flat outer faces 49, separated by the helical grooves 47 which extend from one end to the other.

The flat outer faces 49 preferably have a width of about that of the grooves 47, or may be slightly smaller. For a roller diameter of one and one-half to one and three-quarter inches, the grooves 47 can be spaced to the order of 16 per inch and a depth of about thirty thousandths of an inch which have been found satisfactory in use.

The covering 46 can easily be replaced when unserviceable, thereby maintaining the cost of operation at a low level.

The flat faces 49 separated by the grooves 47 which run helically end to end on the roller elements 40, flex because of their resiliency, and thereby act to expel any debris that may be picked up by the covering 46 and also grip the sheets of papers to advance them for folding.

The roller elements 40' each include a collar 45' similar to collar 45, and with a set screw 41 therein to prevent rotation and sidewise movement, but permit of adjustment and removal as desired. The elements 40' each has a layer 46' of resilient material bonded thereto which may be of plastic, natural or synthetic as desired, and can be of rubber, urethane or other desired resilient materials. The surface 46' of element 40' can be smooth as illustrated, or roughened by a diamond pattern (not shown), or other patterns as desired by the machine operator for the particular operation and material being folded.

The roller elements 40'' each include a collar 45'' which can be formed of steel and have a smooth or roughened surface, such as a diamond pattern **46*b* as illustrated. The elements 40'', as well as the other elements 40 and 40'** can be alone or in any desired combination as selected by the machine operator for the particular operation, and likewise the outer coverings can be solid or resilient and of whatever suitable materials as needed for the folding machine operator.

Figure 3:
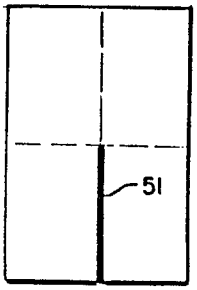
FIG. 3 is a top view of a sheet of paper with a single glue line thereon.

FIG. 3 illustrates a sheet of paper 50 which has had a single line of glue 51 laid thereon by one glue heads 15, and which may be folded and joined to provide an 8, 12, or 16 page signature.

Figure 4:
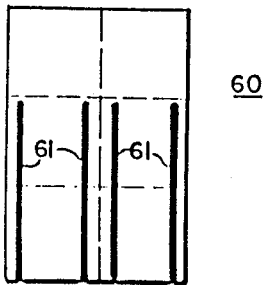
FIG. 4 is a top view of a sheet of paper with four parallel glue lines thereon.

FIG. 4 illustrates a sheet of paper 60 which has had four parallel lines of glue 61 laid thereon, by four glue heads 15, and which may be folded and joined to provide a double lottery ticket.

Figure 5:
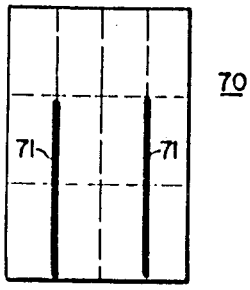
FIG. 5 is a top view of a sheet of paper with two parallel glue lines thereon.

FIG. 5 illustrates a sheet of paper 70 which has had two parallel lines of glue 71 laid thereon, by two glue heads 15, and which may be folded and joined to provide an 8, 12, or 16 page signature.

Figure 6:
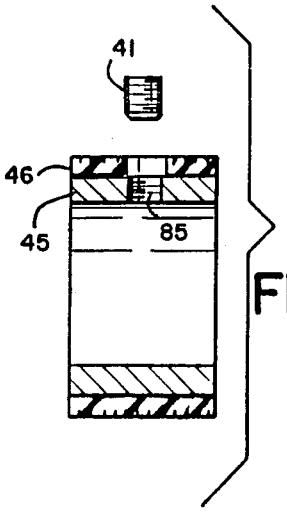
FIG. 6 is a vertical sectional view of a typical complete roller element ready for installation and use.

FIG. 6 illustrates a roller element 40 with a collar 45 and layer 46 with a threaded hole 85 to receive the set screw 41.

Figure 7:
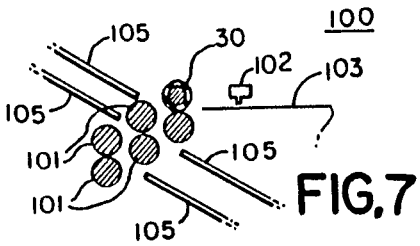
FIG. 7 is a diagrammatic view of a folding machine using one of the rollers of the invention.

Referring now more particularly to FIG. 7, a diagrammatic view of a folding machine 100 is illustrated, which includes one universal fold roller 30 of the invention which may have whatever combination of elements 40, 40', and 40'' as required. Roller 30 is the first and top roller of a series of rollers 101, which rollers 101 are of conventional type. A glue head 102 is disclosed as well as a feed belt 103. A plurality of fold plates 105 are provided and, in this arrangement, an eight page signature can be produced which uses the first fold plate 105 to make the first fold and the subsequent sets of rollers and plates to make the remaining folds.

Figure 8:
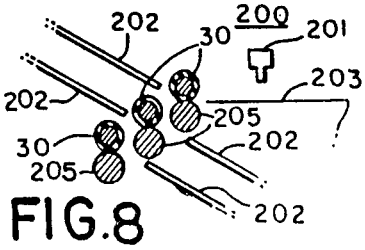
FIG. 8 is a view similar to FIG. 7 but illustrating a folding machine which uses three rollers of the invention.

Referring now to FIG. 8, a diagrammatic view of a folding machine 200 is shown, which includes glue heads 201, fold plates 202, feed belt 203, and three universal fold roller 30 of the invention, which may contain any combination of roller elements 40, 40', or 40'' as required. The roller 30 is in combination with opposed rollers 205 of conventional type. In this arrangement a twelve page signature can be obtained by the use of the three top mounted fold rollers 30 of the invention.

It should be noted that the elements 40, 40', or 40'' can be placed on shaft 35 end to end, or separated in any combination as required to provide for as many or as few glue lines as are desired, and consistent with the capabilities of the folding machine on which the universal roller 30 is used. The spaces 90 are located at the glue lines 20 so that no glue gets on the roller elements 40, 40', or 40'', and so that the sheets of paper 21 are advanced for folding as required. Removal and/or relocation of the roller elements 40, 40', or 40'' merely requires loosening and tightening of the set screw 41 and their placement along the shaft 35.

It should also be noted that universal roller 30 can be used as an idler roller or it can be driven, as required by the material to be folded and/or the operations to be performed in the folding machine.

It will thus be seen that a universal roller has been provided with which the objects of the invention are achieved.

I claim:

1. In a paper folding machine which uses rollers that are fixedly and transversely mounted between bearing blocks, which rollers advance the paper to be folded and wherein apparatus is provided for dispensing at least one glue line onto a sheet of paper prior to folding, said apparatus including a transversely mounted adjustable glue head, and wherein at least one of the rollers comprises a shaft mounted in said bearing blocks, a plurality of roller elements detachable mounted to said shaft in fixed non-rotational relation, each of said roller elements having individual transverse adjustment means cooperating with said shaft to provide unlimited transverse adjustments while said shaft is in said machine, at least one of said roller elements is spaced from the other roller elements to provide a space therebetween so that a sheet of paper with at least one glue line thereon may be gripped and advanced by said roller, said roller elements each including a collar, and an outer surface for engagement with said sheets of paper.

2. A roller as defined in claim 1 in which said shaft has a flat portion thereon, and said roller elements each have set screws for engagement with said flat portion to retain said elements from rotational or transverse movement thereon.

3. A roller as defined in claim 1 in which said collar is provided with an outer covering.

4. A roller as defined in claim 3 in which said outer covering is resilient.

5. A roller as defined in claim 1 in which said roller element outer surface is hard.

6. A roller as defined in claim 4 in which said covering has an outer roughened surface.

7. A roller as defined in claim 6 in which said roller element outer surface is roughened.

* * * * *